US009902081B2

(12) United States Patent
Horiba

(10) Patent No.: US 9,902,081 B2
(45) Date of Patent: Feb. 27, 2018

(54) PLATE MATERIAL PROCESSING SYSTEM

(71) Applicant: MURATA MACHINERY, LTD., Kyoto-shi, Kyoto (JP)

(72) Inventor: Yasushi Horiba, Inuyama (JP)

(73) Assignee: MURATA MACHINERY, LTD., Fushimi-ku (JP)

( * ) Notice: Subject to any disclaimer, the term of this patent is extended or adjusted under 35 U.S.C. 154(b) by 352 days.

(21) Appl. No.: 14/083,618

(22) Filed: Nov. 19, 2013

(65) Prior Publication Data

US 2014/0072390 A1 Mar. 13, 2014

Related U.S. Application Data

(63) Continuation of application No. PCT/JP2012/059328, filed on Apr. 5, 2012.

(30) Foreign Application Priority Data

May 23, 2011 (JP) ..... 2011-114463

(51) Int. Cl.
*B21D 43/04* (2006.01)
*B26D 7/01* (2006.01)
(Continued)

(52) U.S. Cl.
CPC ..... *B26D 7/015* (2013.01); *B21D 43/105* (2013.01); *B21D 43/11* (2013.01)

(58) Field of Classification Search
CPC ..... B26D 7/015; B21D 43/11; B21D 43/105
See application file for complete search history.

(56) References Cited

U.S. PATENT DOCUMENTS 3,823,836 A * 7/1974 Cheney ..... H01L 21/67778 414/331.18
4,648,786 A * 3/1987 Sakurai ..... B21D 43/05 198/468.3
(Continued)

FOREIGN PATENT DOCUMENTS

JP 59-074930 U 5/1984
JP 03-076840 U 8/1991
(Continued)

OTHER PUBLICATIONS

International Search Report dated Jul. 10, 2012, issued in corresponding application No. PCT/JP2012/059328.
(Continued)

*Primary Examiner* — Christopher M Koehler
*Assistant Examiner* — Joel Crandall
(74) *Attorney, Agent, or Firm* — Westerman, Hattori, Daniels & Adrian, LLP

(57) ABSTRACT

A plate material processing system includes a plate material processing machine and a loader. The plate material processing machine holds a front end portion of an unprocessed plate material by a work holder and moves the unprocessed plate material on a table forward, backward, leftward and rightward. The loader includes: a plate material attaching unit; and a pivoting mechanism for pivoting the plate material attaching unit on a predefined arc-shaped trajectory while maintaining the plate material attaching unit in a constant orientation as viewed in a planar manner. When the plate material attaching unit is at a foremost position, the work holder is positioned to the other side of the left and right sides relative to a processing head, away from the unprocessed plate material loading position side, thereby preventing the work holder and the plate material attaching unit from interfering with each other.

9 Claims, 4 Drawing Sheets

(51) Int. Cl.
*B21D 43/10* (2006.01)
*B21D 43/11* (2006.01)

(56) References Cited

U.S. PATENT DOCUMENTS

| | | | | | |
|---|---|---|---|---|---|
| 4,808,059 | A * | 2/1989 | Eddy | B23Q 7/04 | 414/283 |
| 5,151,009 | A * | 9/1992 | Lockert | B65H 3/0816 | 271/189 |
| 5,885,051 | A * | 3/1999 | Azuma | B28D 5/0082 | 414/744.4 |
| 2002/0148820 | A1 * | 10/2002 | Tomlinson | B23Q 3/18 | 219/121.82 |

FOREIGN PATENT DOCUMENTS

| | | | |
|---|---|---|---|
| JP | 05-70736 | U | 9/1993 |
| JP | 10-249757 | A | 9/1998 |
| JP | 2006-041233 | A | 2/2006 |
| JP | 2007-196235 | A | 8/2007 |
| JP | 4424344 | B2 | 3/2010 |
| WO | 1998/041366 | A1 | 9/1998 |

OTHER PUBLICATIONS

Notification of Transmittal of Translation of the International Preliminary Report on Patentability (Form PCT/IB/338) of International Application No. PCT/JP2012/059328, dated Dec. 5, 2013, with FormsPCT/IB/373 and PCT/ISA/237.

* cited by examiner

PLATE MATERIAL PROCESSING SYSTEM

CROSS REFERENCE TO THE RELATED APPLICATION

This application is a continuation application, under 35 U.S.C §111(a) of international application No. PCT/JP2012/059328, filed Apr. 5, 2012, which claims priority to Japanese patent application No. 2011-114463, filed May 23, 2011, the entire disclosure of which is herein incorporated by reference as a part of this application.

BACKGROUND OF THE INVENTION

Field of the Invention

The present invention relates to plate material processing systems that load and unload plate materials, and perform processing, such as a punching process, on the plate materials.

Description of Related Art

Conventionally, in plate material processing systems, plate materials are loaded into and unloaded from plate material processing machines such as punch presses by orthogonal coordinate type loaders (see, for example, Patent Document 1). The orthogonal coordinate type loader moves a plate material attaching unit having the plate material attached thereto, forward, backward, leftward, or rightward, whereby the plate material is moved among an unprocessed plate material loading position in the plate material processing machine, an unprocessed plate material waiting position located lateral to the plate material processing machine, and a produced plate material unloading position located lateral to the plate material processing machine, thereby loading and unloading the plate material. For example, in the case of a loader (plate material transportation device) described in Patent Document 1, a movable base member, that is elongated in the leftward-rightward direction, is mounted on a stationary base member so as to be movable forward and backward, and a travelling member is mounted so as to be able to advance and retreat along the movable base member, and a plate material attaching unit is mounted to the traveling unit. The movable base member is moved forward and backward relative to the stationary base member, and the traveling unit is moved leftward and rightward relative to the movable base member, to move the plate material attaching unit, forward, backward, leftward, and rightward.

As loaders different from the orthogonal coordinate type loaders, pivoting loaders are known (for example, Patent Document 2). In the pivoting loader, a pivoting arm is disposed so as to be pivotable about a pivot shaft along the vertical direction, and a plate material attaching unit is mounted at the tip end of the pivoting arm. An unprocessed plate material loading position, an unprocessed plate material waiting position, and a produced plate material unloading position are along a pivoting trajectory of the plate material attaching unit. In the case of the pivoting loader, the plate material attaching unit having the plate material attached thereto is pivoted to load and unload the plate material.

PRIOR ART DOCUMENT

[Patent Document 1] Japanese Patent No. 4424344

[Patent Document 2] JP Laid-open Utility Model Publication No. 3-76840

In both the orthogonal coordinate type loader and the pivoting loader, the plate material attaching unit is allowed to move upward and downward in order to lift or lower the plate material at the unprocessed plate material loading position, at the unprocessed plate material waiting position, and at the produced plate material unloading position. Therefore, in the orthogonal coordinate type loader, the plate material attaching unit is moved in the three-axis directions, that is, moved in the forward-backward direction, in the leftward-rightward direction, and in the up-down direction. Therefore, at least three drive sources are necessary, thereby increasing production cost and operation cost.

Further, in the conventional pivoting loaders, an orientation of the plate material attaching unit as viewed in a planar manner is changed depending on a phase in pivoting of the pivoting arm. Therefore, there is a limitation in determining the unprocessed plate material waiting position and the produced plate material unloading position, and it is difficult to install a plate material processing system including the plate material processing machine and the loader in a limited narrow space.

SUMMARY OF THE INVENTION

An object of the present invention is to make available a plate material processing system that has the reduced number of drive sources for a loader, to allow reduction in cost, as compared to an orthogonal coordinate type loader, and that can be installed even in a limited narrow space.

A plate material processing system of the present invention includes a plate material processing machine to perform processing on an unprocessed plate material, and a loader to load the unprocessed plate material into the plate material processing machine. The plate material processing machine includes: a processing head to perform processing on the unprocessed plate material; a table on which the unprocessed plate material is placed; and a plate material moving mechanism to move a plate material on the table forward, backward, leftward, and rightward. The plate material moving mechanism includes a carriage that is movable forward and backward; and a work holder, mounted to the carriage so as to be movable leftward and rightward, to hold a front end portion of the unprocessed plate material. The loader includes: a plate material attaching unit capable of attaching to the unprocessed plate material; and a pivoting mechanism to pivot the plate material attaching unit on a predefined arc-shaped trajectory while maintaining the plate material attaching unit in a constant orientation as viewed in a planar manner. The pivoting mechanism shifts the plate material attaching unit on the arc-shaped trajectory between an unprocessed plate material loading position and an unprocessed plate material waiting position, the unprocessed plate material loading position being on a portion of the table, which portion is positioned forwardly of the processing head and on one side of the table in a leftward-rightward direction, the unprocessed plate material waiting position being positioned on the one side of the table and backwardly of the unprocessed plate material loading position. When the plate material attaching unit is at a foremost position, on the arc-shaped trajectory, between the unprocessed plate material loading position and the unprocessed plate material waiting position, the plate material attaching unit is positioned so as to interfere with the work holder that is positioned on the one side in a range in which the work holder is movable leftward and rightward in a state where the carriage is at a foremost position in a range in which the carriage moves forward and backward. When the plate material attaching unit is at the foremost position, the plate material processing machine positions the work holder to the other side of the left and right sides relative to the processing head, away from the unprocessed plate material loading position side.

In this configuration, in the loader, the plate material attaching unit attaches to the unprocessed plate material at the unprocessed plate material waiting position, and the plate material attaching unit attaching thereto pivots on the arc-shaped trajectory to the unprocessed plate material loading position in the plate material processing machine, and releases the unprocessed plate material, thereby loading the unprocessed plate material onto the table of the plate material processing machine. When the plate material attaching unit is at a foremost position, on the arc-shaped trajectory, between the unprocessed plate material loading position and the unprocessed plate material waiting position, the plate material attaching unit is positioned so as to interfere with the work holder that is positioned on the one side in a range in which the work holder of the plate material processing machine is movable leftward and rightward in a state where the carriage of the plate material processing machine is at a foremost position in a range in which the carriage moves forward and backward. However, when the unprocessed plate material is loaded by the loader, the work holder of the plate material processing machine is positioned to the other side of the left and right sides relative to the processing head, away from the unprocessed plate material loading position side. Therefore, the plate material attaching unit and the work holder do not interfere with each other.

In the plate material processing system, the loader pivots the plate material attaching unit to shift the plate material attaching unit between the unprocessed plate material loading position and the unprocessed plate material waiting position. Therefore, the number of drive sources may be less, by one, than the number of drive sources of the orthogonal coordinate type loader. Thus, production cost and operation cost for the loader can be reduced.

Further, as described above, when the unprocessed plate material is loaded, the work holder is retreated. Thus, while the plate material attaching unit is prevented from interfering with the work holder, the carriage can be positioned close to the processing head when the carriage is positioned at the foremost position in the range in which the carriage moves forward and backward. Therefore, a dimension, in the forward-backward direction, of the plate material processing machine can be reduced, and the plate material processing system can be installed in a limited narrow space.

In this invention, a pivot about which the plate material attaching unit is pivoted by the pivoting mechanism is positioned to one side of the left and right sides relative to the processing head, and backward of the table. When a position of the plate material attaching unit and a position of the pivot are equivalent in the leftward-rightward direction, a position, in a forward-backward direction, of the plate material attaching unit may be the foremost position on the arc-shaped trajectory. The unprocessed plate material loading position may be a position which is reached by pivoting from the foremost position toward the other side in the leftward-rightward direction. The unprocessed plate material waiting position may be a position, backward of the pivot, which is reached by pivoting from the foremost position toward one side in the leftward-rightward direction. A produced plate material unloading position may be between the foremost position on the arc-shaped trajectory, and the unprocessed plate material waiting position.

When the pivot for the plate material attaching unit is positioned to one side of the left and right sides relative to the processing head, and backward of the table, the pivoting mechanism can be positioned so as not to interfere with the plate material processing machine. Further, a radius, around which the plate material attaching unit pivots, is made relatively small, and the unprocessed plate material waiting position can be prevented from being backward of the plate material processing machine. As a result, the plate material processing system can be installed in a limited narrow space.

When the produced plate material unloading position is between the foremost position on the arc-shaped trajectory and the unprocessed plate material waiting position, both the loading of the unprocessed plate material into the plate material processing machine and the unloading of the produced plate material from the plate material processing machine can be performed by the plate material attaching unit being pivoted. Further, the unprocessed plate material waiting position and the produced plate material unloading position can be close to each other. Consequently, the plate material can be smoothly moved. In the description herein, the plate material refers to an unprocessed plate material, a produced plate material, and a plate material being changed from the unprocessed plate material to the produced plate material.

Preferably, the unprocessed plate material waiting position and the produced plate material unloading position are equivalent in the leftward-rightward direction. In this case, supply of the unprocessed plate material to the unprocessed plate material waiting position, and discharge of the produced plate material from the produced plate material unloading position can be performed at the equivalent positions in the leftward-rightward direction. Therefore, supply and discharge of the plate material can be facilitated at the unprocessed plate material waiting position and the produced plate material unloading position. For example, when supply and discharge of the plate material is performed by using a transportation vehicle such as a forklift, a path on which the transportation vehicle travels can be easily obtained. Further, a table on which an unprocessed plate material waiting at the unprocessed plate material waiting position is supported, and a table on which a produced plate material unloaded into the produced plate material unloading position is supported can be integrated with each other, thereby reducing cost for providing these tables.

In this invention, preferably, the pivoting mechanism includes: a pivot that extends in the vertical direction and is rotatably supported by the loader; a pivoting arm that has a base end supported by the pivot, and that pivots together with the pivot; a stationary arm having a base end fixed to the loader; and a link having a base end that is connected to a tip end of the stationary arm so as to be rotatable about a vertically extending shaft, and the plate material attaching unit is supported at a tip end of the pivoting arm and a tip end of the link. In this configuration, the pivoting mechanism having a simplified structure can be obtained.

In this case, the plate material attaching unit may be supported at the tip end of the pivoting arm and the tip end of the link through a first rod and a second rod, respectively, and a straight line connecting between a center of the pivot and a center of the first rod and a straight line connecting between a center of a shaft of the stationary arm and a center of the second rod may be parallel to each other, and a straight line connecting between the center of the pivot and the center of the shaft of the stationary arm and a straight line connecting between the center of the first rod and the center of the second rod may be parallel to each other.

Any combination of at least two constructions, disclosed in the specification and/or the accompanying drawings should be construed as included within the scope of the present invention.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like or corresponding parts throughout the several views, and:

DESCRIPTION OF EMBODIMENTS

Figure 1:
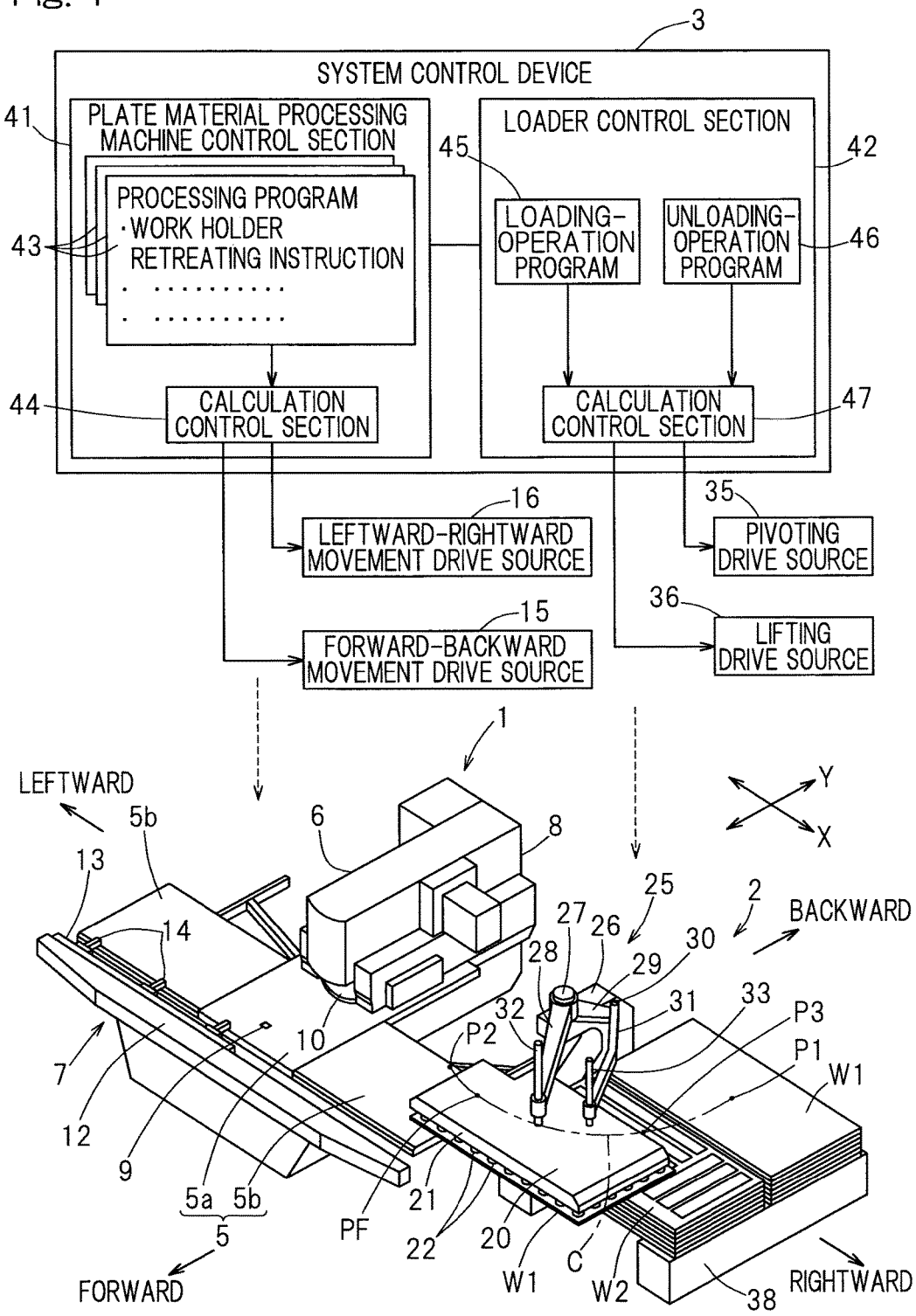
FIG. 1 is a perspective view of a mechanical portion of a plate material processing system, including a block diagram of a control system, according to an embodiment of the present invention.

An embodiment of the present invention will be described with reference to the drawings. As shown in FIG. 1, a plate material processing system includes a plate material processing machine 1, a loader 2, and a system control device 3. The plate material processing machine 1 performs processing on an unprocessed plate material W1, and is implemented as a punch press in the present embodiment. The loader 2 operates to load the unprocessed plate material W1 into the plate material processing machine 1, and unload a produced plate material W2 processed by the plate material processing machine 1. The system control device 3 controls the plate material processing machine 1 and the loader 2 that are mechanical portions of the plate material processing system.

The plate material processing machine 1 implemented as a punch press includes: a table 5 on which a plate material is placed; a processing head 6 that performs a punching process for the plate material on the table 5; and a plate material moving mechanism 7 that moves the plate material on the table 5 in the forward-backward direction (in the Y-axis direction) and in the leftward-rightward direction (in the X-axis direction). In the description herein, the plate material refers to the unprocessed plate material W1, the produced plate material W2, and a plate material being changed from the unprocessed plate material W1 to the produced plate material W2.

The table 5 includes: a stationary table portion 5*a* that is fixed to a processing machine frame 8; and movable table portions 5*b* that move forward and backward together with a carriage 12 described below. An end locator 9 is provided at the center position, in the leftward-rightward direction, of the stationary table portion 5*a*, so as to be able to project from or retract into a table surface.

The processing head 6 is a mechanism for moving a punching tool (not shown) on a circular or sector-shaped turret 10 upward and downward by driving a ram (not shown) for upward and downward movement. Namely, a pair of upper and lower turrets 10 that can be rotated and indexed is disposed in the processing machine frame 8, and a plurality of punching tools (not shown) and die tools (not shown) are aligned in the outer circumferential portions of the respective turrets 10 along the circumferential direction. The punching tools and the die tools are, for example, tools for a hole forming process or a shaping process. In a state where the punching tools and the die tools are indexed to a predetermined punching position P, the punching tools are moved upward and downward by means of the ram of the processing head 6, to perform predetermined processing on the plate material. The plate material processing machine 1 may be a laser processing machine. In this case, the processing head 6 is implemented as a laser head.

The plate material moving mechanism 7 includes: the carriage 12 mounted so as to be movable in the forward-backward direction relative to the processing machine frame 8; a cross slide 13 mounted to the carriage 12 so as to be movable in the leftward-rightward direction; and a plurality of work holders 14 that are mounted to the cross slide 13 and can hold a front end portion of the plate material. The carriage 12 and the cross slide 13 are driven so as to advance or retreat by driving of a forward-backward movement drive source 15 and a leftward-rightward movement drive source 16, respectively. The work holders 14 may be mounted directly to the carriage 12 without providing the cross slide 13. In this case, the work holders 14 are mounted so as to be movable in the leftward-rightward direction relative to the carriage 12.

Figure 6:
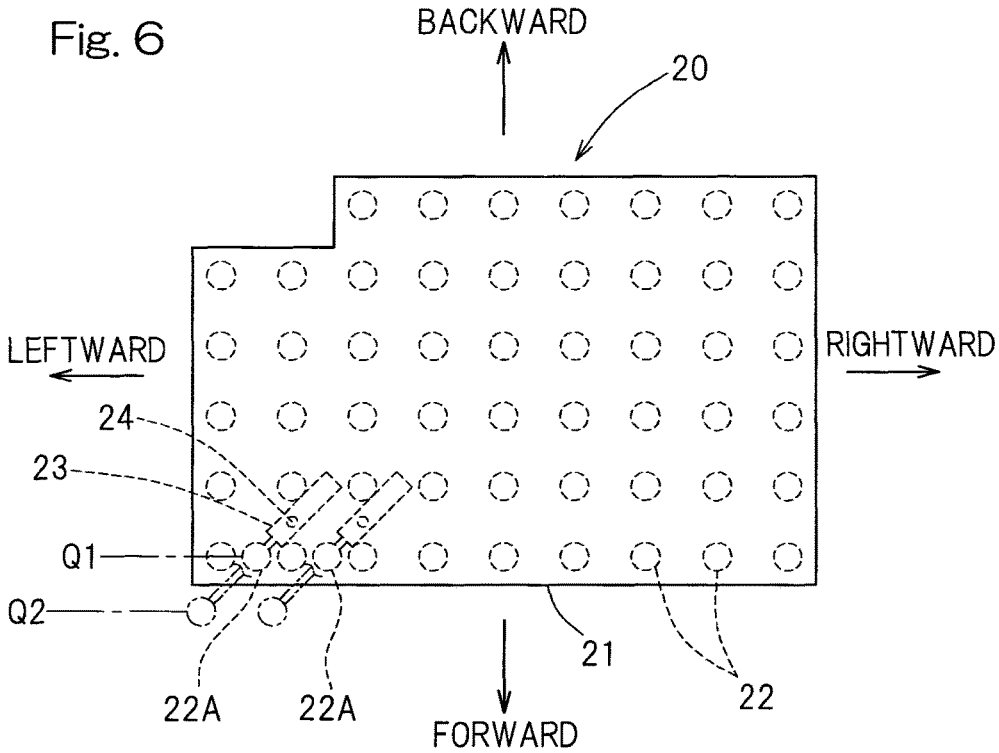
FIG. 6 is a partial cutaway plan view of a plate material attaching unit of the plate material processing system according to the embodiment.

The loader 2 includes a plate material attaching unit 20 that attaches to a top surface of the plate material to hold the plate material. The plate material attaching unit 20 of the present embodiment has a structure in which, as shown in FIG. 6, an attaching pad support member 21 has a plurality of attaching pads 22 aligned in the forward-backward direction and the leftward-rightward direction, and the plate material is attached to and held by the attaching pads 22. Each of the attaching pads 22 is implemented as, for example, vacuum suction pads. In this case, the attaching pads 22 are connected to respective negative pressure sources (not shown) such as blowers through piping. The attaching pads 22 may be implemented as electromagnets, and attract and attach to the plate material by magnetic force.

In addition to the attaching pads 22 aligned in the forward-backward direction and the leftward-rightward direction, positioning attaching pads 22A are provided, in the foremost line in a group of the attaching pads 22, at an end portion (the left end portion) on the processing head 6 side. In an illustrated example, two positioning attaching pads 22A are provided so as to be aligned in the leftward-rightward direction. The positioning attaching pads 22A are each supported by an operating portion of a positioning drive source 23 such as an air cylinder, and can be shifted between a steady-state position Q1 and a positioning position Q2 that is diagonally left-forward of the steady-state position Q1, by extending and contracting operation of the positioning drive source 23. The positioning drive source 23 is supported so as to be able to oscillate, relative to the attaching pad support member 21, about an oscillation shaft 24 extending in the vertical direction, and a phase around the oscillation shaft 24 is maintained in an elastically defined equilibrium state by equilibrating means (not shown) such as a spring.

The plate material attaching unit 20 is supported by a pivoting mechanism 25 including a parallel link mechanism, as shown in FIG. 1. Namely, the pivoting mechanism 25 includes: a pivot shaft 27 that extends in the vertical direction and is rotatably supported by a loader frame 26 through a lifting unit (not shown); a pivoting arm 28 that has its base end supported by the pivot shaft 27, and pivots in conjunction with the pivot shaft 27; a stationary arm 29 having its base end fixed to the lifting unit; and a link 31 having its base end connected to a tip end portion of the stationary arm 29 so as to be rotatable about a shaft 30 extending in the vertical direction. The attaching pad support member 21 of the plate material attaching unit 20 is supported through first and second rods 32 and 33 at a tip end portion of the pivoting arm 28 and a tip end portion of the link 31, respectively. The first rod 32 provided at the tip end portion of the pivoting arm 28 is located at almost the center of the plate material attaching unit 20 as viewed in a planar manner.

Figure 2:
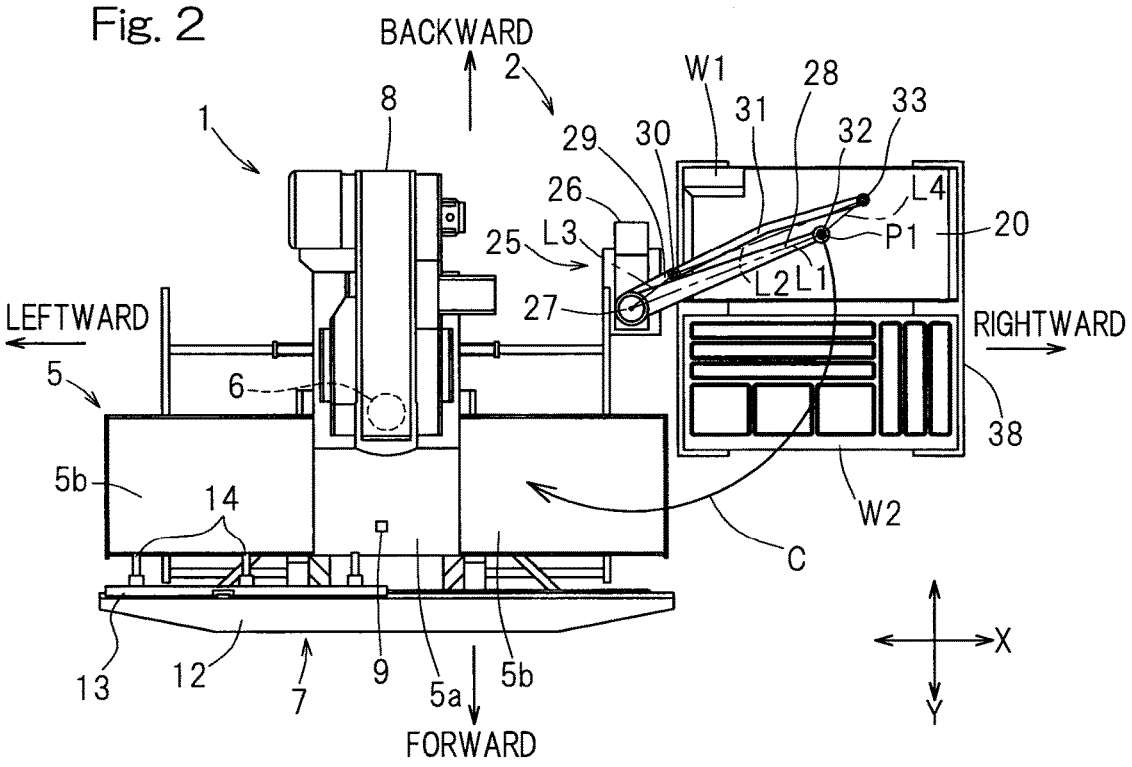
FIG. 2 is a plan view illustrating a state of the mechanical portion of the plate material processing system according to the embodiment.

As viewed in a planar manner in FIG. 2, a straight line L1 connecting between the center of the pivot shaft 27 and the center of the first rod 32 and a straight line L2 connecting between the center of the shaft 30 and the center of the second rod 33 are parallel to each other, and a straight line L3 connecting between the center of the pivot shaft 27 and the center of the shaft 30 and a straight line L4 connecting between the center of the first rod 32 and the center of the second rod 33 are parallel to each other. Namely, the parallel link mechanism is structured by the pivoting arm 28, the stationary arm 29, the link 31, and a portion of the plate material attaching unit 20.

The pivot shaft 27 is positioned on one side (right side) of the left and right sides relative to the processing head 6 shown in FIG. 1, and backward of the table 5. The pivot shaft 27 is driven to pivot by means of a pivoting drive source 35 implemented as an electric motor or the like. Due to pivoting of the pivot shaft 27, the plate material attaching unit 20 supported by the pivoting mechanism 25 including the parallel link mechanism pivots on a predefined arc-shaped trajectory C while maintaining the plate material attaching unit 20 in a constant orientation as viewed in a planar manner.

The lifting unit (not shown) that supports the pivot shaft 27 is mounted to the loader frame 26 so as to be able to ascend and descend, and is driven so as to ascend and descend through a drive transmission mechanism (not shown) by a lifting drive source 36 (FIG. 1) such as a servo motor. Thus, the pivoting arm 28, the stationary arm 29, and the link 31 are moved upward and downward together with the lifting unit and the pivot shaft 27, thereby changing a height of the plate material attaching unit 20. The drive transmission mechanism is a mechanism for converting a rotational motion to a linearly reciprocating motion, and is formed by, for example, an endless chain mounted between upper and lower sprockets being connected to the lifting unit. When the chain is rotated by the lifting drive source 36, the lifting unit is moved upward and downward. Instead of the pivot shaft 27 being moved upward and downward, the first and the second rods 32 and 33 may be moved upward and downward, thereby changing a height of the plate material attaching unit 20.

Positions at which the plate material attaching unit 20 is to stop are determined along the arc-shaped trajectory C as described below (FIG. 2 to FIG. 5). An unprocessed plate material waiting position P1 (FIG. 2) is positioned on one side (right side) of the left and right sides of the table 5 and backward of an unprocessed plate material loading position P2. In other words, the unprocessed plate material waiting position P1 is a position, backward of the pivot shaft 27, which is reached by pivoting being performed from a foremost position PF (FIG. 3) in one side direction (the right side direction) of the left direction or the right direction. The foremost position PF is the foremost position, on the trajectory C, at which the plate material attaching unit 20 can be positioned, and is a position at which the plate material attaching unit 20 is positioned directly in front of the pivot shaft 27. The unprocessed plate material waiting position P1 and a produced plate material unloading position P3 described below are on a common plate material placing table 38.

In a state where the plate material attaching unit 20 is at the foremost position PF, when the carriage 12 is positioned at the foremost position in a range in which the carriage 12 moves forward and backward, and the work holders 14 are positioned at one side (rightmost position) of a leftmost position or a rightmost position in a range in which the work holders 14 can be moved leftward and rightward, the plate material attaching unit 20 and the work holders 14 are positioned so as to interfere with each other.

The unprocessed plate material loading position P2 (FIG. 4) is a position on the table 5, which position is forward of the processing head 6 and is one side portion (a side portion in the rightward direction) of the table 5 in the leftward-rightward direction. In other words, the unprocessed plate material loading position P2 is a position which is reached by pivoting from the foremost position PF (FIG. 3) toward the other side (left side) in the leftward-rightward direction.

The produced plate material unloading position P3 (FIG. 5) is a position, on the arch-shaped trajectory C, between the foremost position PF (FIG. 3) and the unprocessed plate material waiting position P1 (FIG. 2). The unprocessed plate material waiting position P1 and the produced plate material unloading position P3 are equivalent in the leftward-rightward direction.

As shown in FIG. 1, the system control device 3 includes a plate material processing machine control section 41 that controls the plate material processing machine 1, and a loader control section 42 that controls the loader 2. The plate material processing machine control section 41 includes a computer-type numerical control device, a programmable controller, and the like. A processing program 43 set for each unprocessed plate material W1 is interpreted and executed by a calculation control section 44 to issue a control instruction to each of the drive sources of the plate material processing machine 1, thereby controlling the plate material processing machine 1. The processing program 43 includes a work holder retreating instruction to be executed prior to each instruction associated with processing. The work holder retreating instruction is an instruction for controlling the leftward-rightward movement drive source 16 when the loader 2 is caused to perform loading operation under the control of the loader control section 42 described below. By this instruction being executed, each of the work holders 14 can be moved together with the cross slide 13 such that the work holders 14 are positioned on the other side (the left side) of the left and right sides relative to the processing head 6, away from the unprocessed plate material loading position P2 side.

The loader control section 42 includes a computer-type programmable controller and the like. A loading-operation program 45 and an unloading-operation program 46 are each interpreted and executed by a calculation control section 47, to issue a control instruction to each of the drive sources of the loader 2, thereby controlling the loader 2. Thus, the loader 2 performs the loading operation for the unprocessed plate material W1 and the unloading operation for the produced plate material W2.

An operation of the plate material processing system will be described.

Firstly, the unprocessed plate material W1 is loaded into the plate material processing machine 1 by the loader 2. In the loading operation performed by the loader 2, as shown in FIG. 2, the plate material attaching unit 20 is positioned at the unprocessed plate material waiting position P1 on the arc-shaped trajectory C, an output to the lifting drive source 36 is performed, the plate material attaching unit 20 is moved downward, and the unprocessed plate material W1 on the plate material placing table 38 is attached to the plate material attaching unit 20. An output to the lifting drive source 36 is performed to move the plate material attaching unit 20 upward, and an output to the pivoting drive source 35 is performed to pivot the plate material attaching unit 20 about the pivot shaft 27 rightward (clockwise) in FIG. 2.

Figure 3:
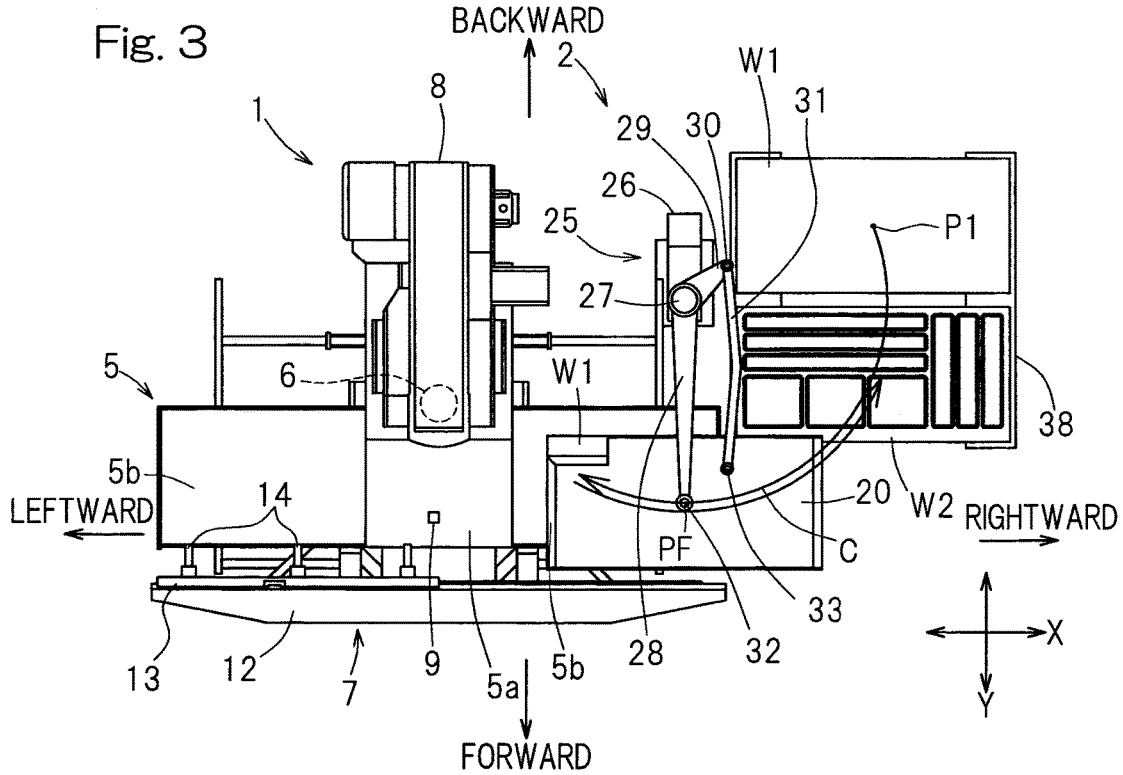
FIG. 3 is a plan view illustrating another state of the mechanical portion of the plate material processing system according to the embodiment.

During the pivoting, as shown in FIG. 3, the plate material attaching unit 20 passes by the foremost position PF. When the plate material attaching unit 20 passes by the foremost position PF, each of the work holders 14 in the plate material processing machine 1 is positioned on the other side (the left side) of the left and right sides relative to the processing head 6, away from the unprocessed plate material loading position P2 side, under the control by the work holder retreating instruction. Therefore, the plate material attaching unit 20 and the work holders 14 do not interfere with each other. The work holders 14 may be retreated in a period between completion of unloading of the produced plate material W2 obtained in the immediately preceding processing and start of loading of the unprocessed plate material W1 to be processed in the immediately following time.

Figure 4:
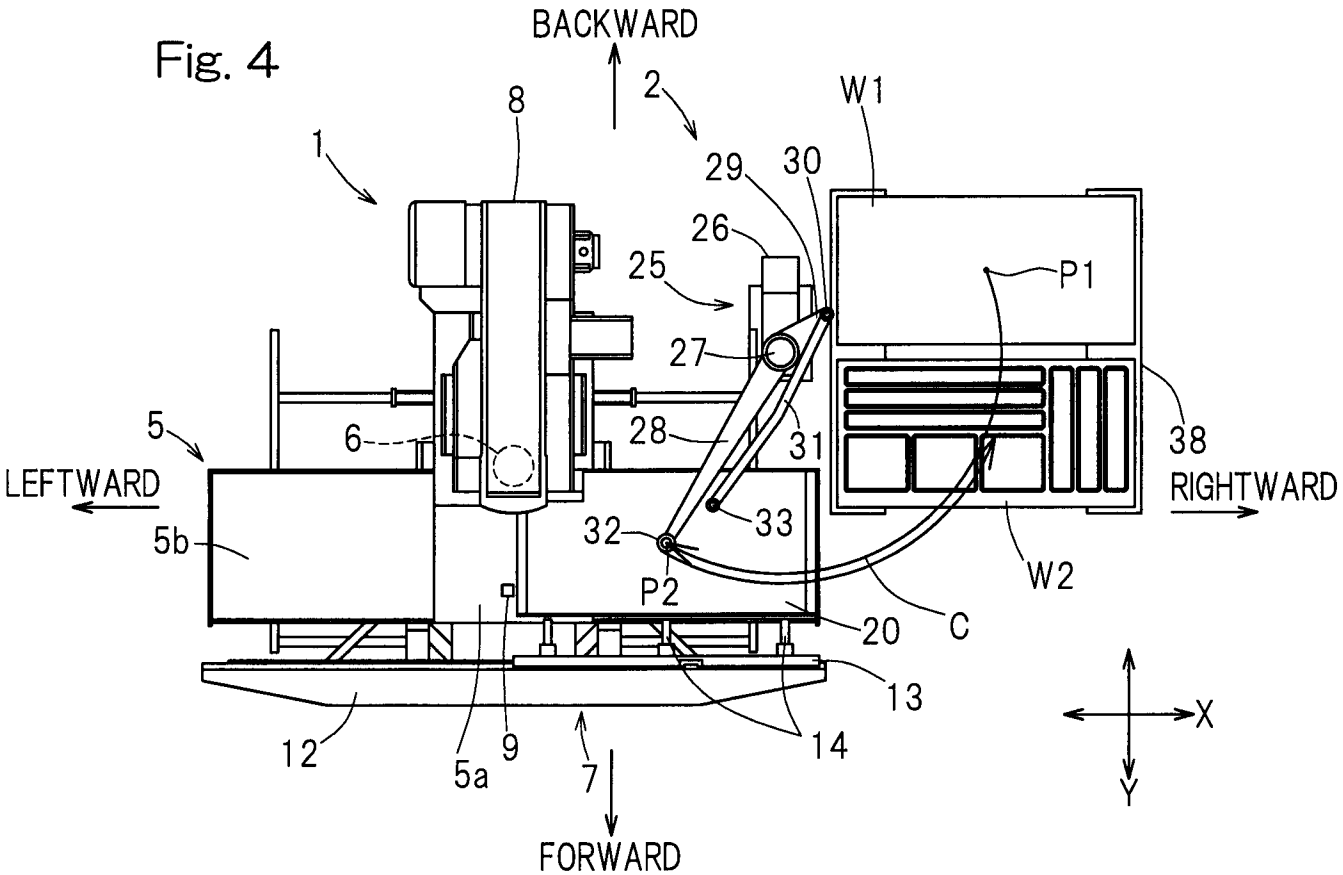
FIG. 4 is a plan view illustrating still further another state of the mechanical portion of the plate material processing system according to the embodiment.

As shown in FIG. 4, the plate material attaching unit 20 pivots to reach the unprocessed plate material loading position P2. At this position, the plate material attaching unit 20 is moved downward, and attaching of the unprocessed plate material W1 to each attaching pad 22 of the plate material attaching unit 20 is then cancelled, to place the unprocessed plate material W1 on the table 5. Thereafter, the work holders 14 are moved toward the unprocessed plate material loading position P2 (rightward). Subsequently, the unprocessed plate material W1 is attached to the plate material attaching unit 20 through only the positioning attaching pads 22A, and the positioning attaching pads 22A are shifted from the steady-state position Q1 (FIG. 6) to the positioning position Q2 (FIG. 6) by driving of the positioning drive source 23. Thus, the unprocessed plate material W1 is moved in the diagonally left-forward direction. The unprocessed plate material W1 is pressed against the work holders 14, and the end locator 9 projecting from the table surface, to be positioned at a reference position.

Figure 5:
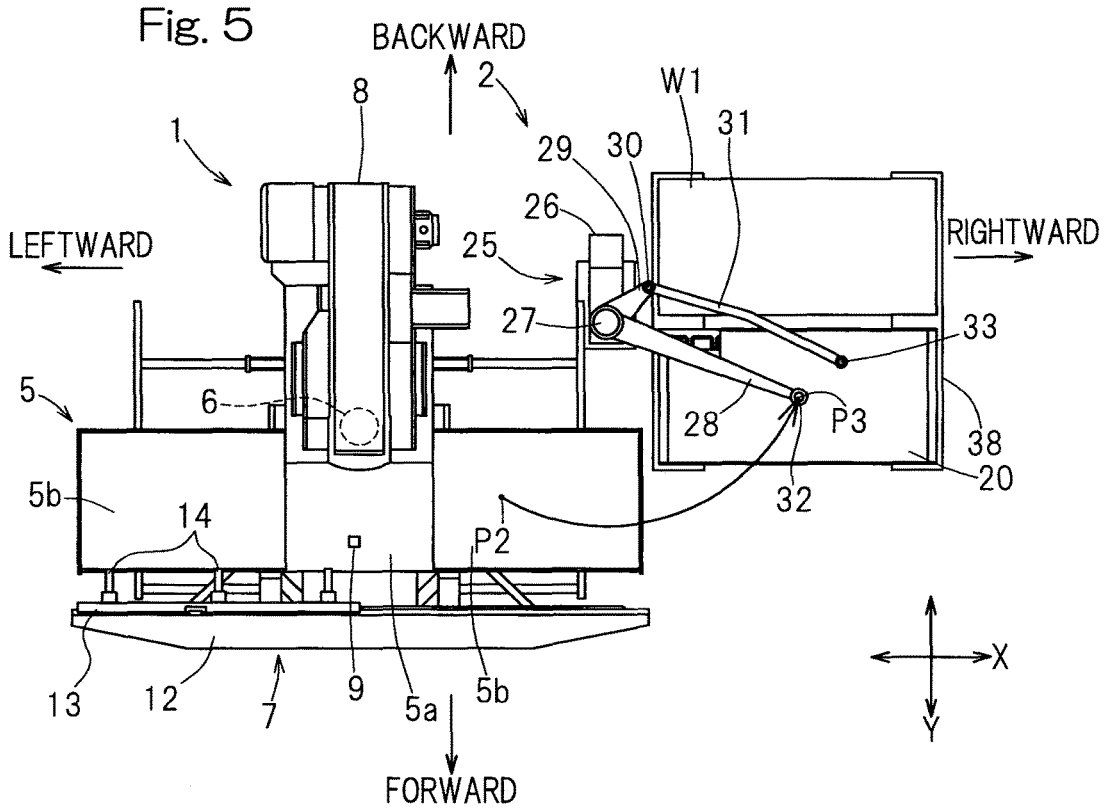
FIG. 5 is a plan view illustrating yet another state of the mechanical portion of the plate material processing system according to the embodiment.

Various processing is performed on the unprocessed plate material W1 positioned at the reference position by the plate material processing machine 1, to obtain the produced plate material W2. The produced plate material W2 is attached to the plate material attaching unit 20, and unloaded into the produced plate material unloading position P3 as shown in FIG. 5. The unloading operation by the loader 2 is performed by upward and downward movement of the plate material attaching unit 20 and pivoting about the pivot shaft 27 being combined, as in the loading operation. For the unloading operation, the plate material attaching unit 20 pivots leftward (counterclockwise). During the pivoting, the plate material attaching unit 20 passes by the foremost position PF. At this time, as in the loading operation, the work holders 14 are positioned on the other side (the left side) of the left and right sides relative to the processing head 6, away from the unprocessed plate material loading position P2 side, and the plate material attaching plate 20 and the work holders 14 do not interfere with each other.

In the plate material processing system, the plate material attaching unit 20 is pivoted by the loader 2, to be shifted among the unprocessed plate material loading position P2, the unprocessed plate material waiting position P1, and the produced plate material unloading position P3. Therefore, the number of drive sources may be less, by one, than the number of drive sources of the orthogonal coordinate type loader. Thus, production cost and operation cost for the loader 2 can be reduced. Further, as described above, when the unprocessed plate material W1 is loaded and the produced plate material W2 is unloaded, the work holders 14 are positioned on the other side (the left side) of the left and right sides relative to the processing head 6, away from the unprocessed plate material loading position P2 side. Therefore, while the plate material attaching plate 20 and the work holders 14 are prevented from interfering with each other, and the carriage 12 can be positioned close to the processing head 6 when the carriage 12 is positioned at a foremost position in the forward-backward movement range. Thus, a dimension, in the forward-backward direction, of the plate material processing machine 1 can be reduced, and the plate material processing system can be installed in a limited narrow space.

The pivot shaft 27 for the plate material attaching unit 20 is positioned on one side (right side) of the left and right sides relative to the processing head 6, and backward of the table 5. Thus, the pivoting mechanism 25 can be positioned so as not to interfere with the plate material processing machine 1. Further, a radius around which the plate material attaching unit 20 pivots is made relatively small, and the unprocessed plate material waiting position P1 can be prevented from being backward of the plate material processing machine 1. As a result, the plate material processing system can be installed in a limited narrow space.

The unprocessed plate material waiting position P1 and the produced plate material unloading position P3 are aligned on the arc-shaped trajectory C of the plate material attaching unit 20. Therefore, by the plate material attaching unit 20 being pivoted, both loading of the unprocessed plate material W1 into the plate material processing machine 1 and unloading of the produced plate material W2 from the plate material processing machine 1 can be performed, thereby smoothly moving the plate material.

The unprocessed plate material waiting position P1 and the produced plate material unloading position P3 are equivalent in the leftward-rightward direction. Therefore, supply of the unprocessed plate material W1 to the unprocessed plate material waiting position P1 and discharge of the produced plate material W2 from the produced plate material unloading position P3 can be performed at the equivalent positions in the leftward-rightward direction, and supply and discharge of the plate material can be facilitated at the unprocessed plate material waiting position P1 and the produced plate material unloading position P3. For example, when supply and discharge of the plate material are performed by using a transportation vehicle such as a forklift, a path on which the transportation vehicle travels can be easily obtained.

Further, a table on which the unprocessed plate material W1 waiting at the unprocessed plate material waiting position P1 is placed, and a table on which the produced plate material W2 unloaded into the produced plate material unloading position P3 is placed may be integrated with each other to provide the common plate material placing table 38, thereby reducing cost for providing tables for the plate material.

Although the present invention has been described above in connection with the preferred embodiments thereof with reference to the drawings, various additions, modifications, or deletions may be made without departing from the gist of the invention. Accordingly, such additions, modifications, and deletions are to be construed as included within the scope of the present invention.

REFERENCE NUMERALS

1 plate material processing machine
2 loader
3 system control device
5 table
6 processing head
7 plate material moving mechanism
12 carriage
14 work holder
16 leftward-rightward movement drive source
20 plate material attaching unit
25 pivoting mechanism
27 pivot shaft
28 pivoting arm
29 stationary arm
30 shaft of stationary arm
31 link
32 first rod
33 second rod
35 pivoting drive source
C trajectory
P1 unprocessed plate material waiting position
P2 unprocessed plate material loading position
P3 produced plate material unloading position
PF foremost position
W1 unprocessed plate material
W2 produced plate material

What is claimed is:

1. A plate material processing system comprising:

a plate material processing machine configured to perform processing on an unprocessed plate material, a loader disposed on one side of the plate material processing machine in a leftward-rightward direction and configured to load the unprocessed plate material into the plate material processing machine, and a control device configured to control the plate material processing machine and the loader, wherein the plate material processing machine includes:

a processing head configured to perform processing on the unprocessed plate material;

a table on which the unprocessed plate material is placed; and a plate material moving mechanism disposed forward of the processing head in a forward-backward direction and configured to move a plate material on the table forward, backward, leftward, and rightward by control of said control device, wherein the plate material moving mechanism includes:

a carriage that is movable forward and backward by control of said control device; and a work holder, mounted to the carriage so as to be movable leftward and rightward, to hold a front end portion of the unprocessed plate material by control of said control device, wherein the loader includes:

a plate material attaching unit capable of attaching to the unprocessed plate material; and a pivoting mechanism configured to pivot the plate material attaching unit on a predefined arc-shaped trajectory around an axis extending in a vertical direction while maintaining the plate material attaching unit in a constant orientation as viewed in said vertical direction, wherein the pivoting mechanism is configured to shift the plate material attaching unit on the arc-shaped trajectory between an unprocessed plate material loading position and an unprocessed plate material waiting position by control of said control device, the unprocessed plate material loading position being on a portion of the table which portion is positioned forward of the processing head and on the one side of the table in the leftward-rightward direction, the unprocessed plate material waiting position being positioned on the one side of the table and backward of the unprocessed plate material loading position, wherein, by control of said control device, when the plate material attaching unit is at a forward-most position, on the arc-shaped trajectory, between the unprocessed plate material loading position and the unprocessed plate material waiting position, the plate material attaching unit is positioned so as to interfere with the work holder that is positioned on the one side in a range in which the work holder is movable leftward and rightward, in a state where the carriage is at a forward-most position in a range in which the carriage moves forward and backward, and wherein, by control of said control device, when the plate material attaching unit is at the forward-most position, the plate material processing machine positions the work holder to an opposite side relative to the processing head in the leftward-rightward direction, away from the unprocessed plate material loading position side, wherein said leftward-rightward direction and said forward-backward direction are defined directions that are perpendicular to each other and perpendicular to said vertical direction, wherein forward is opposite to backward along said forward-backward direction and leftward is opposite to rightward along said leftward-rightward direction.

2. The plate material processing system according to claim 1, wherein a pivot about which the plate material attaching unit is pivoted by the pivoting mechanism is positioned to a same side of relative to the processing head in the leftward-rightward direction, and backward of the table, wherein when a position of the plate material attaching unit and a position of the pivot are equivalent in the leftward-rightward direction, a position, in a forward-backward direction, of the plate material attaching unit is the forward-most position on the arc-shaped trajectory, wherein the unprocessed plate material loading position is a position which is reached by pivoting from the forward-most position toward the opposite side relative to the processing head, in the leftward-rightward direction, wherein the unprocessed plate material waiting position is a position, backward of the pivot, which is reached by pivoting from the forward-most position toward the one side relative to the processing head in the leftward-rightward direction, and wherein a produced plate material unloading position is between the forward-most position on the arc-shaped trajectory, and the unprocessed plate material waiting position.

3. The plate material processing system according to claim 2, wherein the unprocessed plate material waiting position and the produced plate material unloading position are equivalent in the leftward-rightward direction.

4. The plate material processing system according to claim 1, wherein the pivoting mechanism includes:

a pivot that extends in the vertical direction and is rotatably supported by the loader;

a pivoting arm that has a base end supported by the pivot, and that pivots together with the pivot;

a stationary arm having a base end fixed to the loader; and a link having a base end that is connected to a tip end of the stationary arm so as to be rotatable about a vertically extending shaft, and wherein the plate material attaching unit is supported at a tip end of the pivoting arm and a tip end of the link.

5. The plate material processing system according to claim 4, wherein the plate material attaching unit is supported at the tip end of the pivoting arm and the tip end of the link through a first rod and a second rod, respectively, and wherein a straight line connecting a center of the pivot and a center of the first rod and a straight line connecting a center of a shaft of the stationary arm and a center of the second rod are parallel to each other, and wherein a straight line connecting the center of the pivot and the center of the shaft of the stationary arm and a straight line connecting the center of the first rod and the center of the second rod are parallel to each other.

6. A plate material processing system comprising:

a plate material processing machine configured to perform processing on an unprocessed plate material, a loader disposed on one side of the plate material processing machine in a leftward-rightward direction and configured to load the unprocessed plate material into the plate material processing machine, and a control device configured to control the plate material processing machine and the loader, wherein the plate material processing machine includes:

a processing head configured to perform processing on the unprocessed plate material;

a table on which the unprocessed plate material is placed; and a plate material moving mechanism disposed forward of the processing head in a forward-backward direction and configured to move a plate material on the table forward, backward, leftward, and rightward by control of said control device, wherein the plate material moving mechanism includes:

a carriage that is movable forward and backward by control of said control device; and a work holder, mounted to the carriage so as to be movable leftward and rightward, to hold a front end portion of the unprocessed plate material by control of said control device, wherein the loader includes:

a plate material attaching unit capable of attaching to the unprocessed plate material; and a pivoting mechanism configured to pivot the plate material attaching unit on a predefined arc-shaped trajectory around an axis extending in a vertical direction while maintaining the plate material attaching unit in a constant orientation as viewed in said vertical direction, wherein the pivoting mechanism is configured to shift the plate material attaching unit on the arc-shaped trajectory between an unprocessed plate material loading position and an unprocessed plate material waiting position by control of said control device, the unprocessed plate material loading position being on a portion of the table which portion is positioned forward of the processing head and on the one side of the table in the leftward-rightward direction, the unprocessed plate material waiting position being positioned on the one side of the table and backward of the unprocessed plate material loading position, wherein, by control of said control device, when the plate material attaching unit is at a forward-most position, on the arc-shaped trajectory, between the unprocessed plate material loading position and the unprocessed plate material waiting position, the plate material attaching unit is positioned so as to interfere with the work holder that is positioned on the one side in a range in which the work holder is movable leftward and rightward, in a state where the carriage is at a forward-most position in a range in which the carriage moves forward and backward, and wherein, by control of said control device, when the plate material attaching unit is at the forward-most position, the plate material processing machine positions the work holder to an opposite side relative to the processing head in the leftward-rightward direction, away from the unprocessed plate material loading position side, wherein a produced plate material unloading position is between the forward-most position on the arc-shaped trajectory, and the unprocessed plate material waiting position, and wherein the unprocessed plate material waiting position and the produced plate material unloading position are equivalent in the leftward-rightward direction, wherein said leftward-rightward direction and said forward-backward direction are defined directions that are perpendicular to each other and perpendicular to said vertical direction, wherein forward is opposite to backward along said forward-backward direction and leftward is opposite to rightward along said leftward-rightward direction.

7. The plate material processing system according to claim 6, wherein a pivot about which the plate material attaching unit is pivoted by the pivoting mechanism is positioned to a same side of relative to the processing head in the leftward-rightward direction, and backward of the table, wherein when a position of the plate material attaching unit and a position of the pivot are equivalent in the leftward-rightward direction, a position, in a forward-backward direction, of the plate material attaching unit is the forward-most position on the arc-shaped trajectory, wherein the unprocessed plate material loading position is a position which is reached by pivoting from the forward-most position toward the opposite side relative to the processing head, in the leftward-rightward direction, and wherein the unprocessed plate material waiting position is a position, backward of the pivot, which is reached by pivoting from the forward-most position toward the one side relative to the processing head in the leftward-rightward direction.

8. The plate material processing system according to claim 6, wherein the pivoting mechanism includes:

a pivot that extends in the vertical direction and is rotatably supported by the loader;

a pivoting arm that has a base end supported by the pivot, and that pivots together with the pivot;

a stationary arm having a base end fixed to the loader; and a link having a base end that is connected to a tip end of the stationary arm so as to be rotatable about a vertically extending shaft, and wherein the plate material attaching unit is supported at a tip end of the pivoting arm and a tip end of the link.

9. The plate material processing system according to claim 8, wherein the plate material attaching unit is supported at the tip end of the pivoting arm and the tip end of the link through a first rod and a second rod, respectively, and wherein a straight line connecting a center of the pivot and a center of the first rod and a straight line connecting a center of a shaft of the stationary arm and a center of the second rod are parallel to each other, and wherein a straight line connecting the center of the pivot and the center of the shaft of the stationary arm and a straight line connecting the center of the first rod and the center of the second rod are parallel to each other.

* * * * *